US007997896B2

(12) United States Patent
Flohr et al.

(10) Patent No.: US 7,997,896 B2
(45) Date of Patent: Aug. 16, 2011

(54) PREMIX BURNER WITH STAGED LIQUID FUEL SUPPLY AND ALSO METHOD FOR OPERATING A PREMIX BURNER

(75) Inventors: Peter Flohr, Turgi (CH); Gijsbertus Oomens, Nussbaumen (CH); Martin Zajadatz, Küssaberg/Dangstetten (DE)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 11/635,002

(22) Filed: Dec. 7, 2006

(65) Prior Publication Data

US 2007/0099142 A1 May 3, 2007

Related U.S. Application Data

(63) Continuation of application No. PCT/EP2005/052315, filed on May 19, 2005.

(30) Foreign Application Priority Data

Jun. 8, 2004 (CH) ..... 0972/04

(51) Int. Cl.
*F23D 14/62* (2006.01)

(52) U.S. Cl. ..... 431/354; 431/352; 431/351

(58) Field of Classification Search ..... 431/351, 431/352, 354, 350; 60/737, 738
See application file for complete search history.

(56) References Cited

U.S. PATENT DOCUMENTS

| | | | | |
|---|---|---|---|---|
| 5,244,380 | A | 9/1993 | Dobbeling et al. | |
| 5,584,684 | A * | 12/1996 | Dobbeling et al. | 431/285 |
| 5,586,878 | A * | 12/1996 | Dobbeling et al. | 431/351 |
| 2003/0152880 | A1 * | 8/2003 | Eroglu et al. | 431/8 |

FOREIGN PATENT DOCUMENTS

| | | | |
|---|---|---|---|
| EP | 0 503 319 | A2 | 9/1992 |
| EP | 0 711 953 | A2 | 5/1996 |
| EP | 0 916 894 | A1 | 5/1999 |
| WO | WO 95/16881 | A1 | 6/1995 |
| WO | WO 01/96785 | A1 | 12/2001 |

* cited by examiner

*Primary Examiner* — Alfred Basichas
(74) *Attorney, Agent, or Firm* — Buchanan Ingersoll & Rooney PC

(57) ABSTRACT

A premix burner with staged liquid fuel supply is described having at least two partial cone shells which on the radial side form the boundary of a swirl chamber which axialwards conically widens, which partial cone shells are arranged in a partially overlapping manner, the center axes of the partial cone shells of which extend with offset effect in relation to each another, and the mutually overlapping partial cone shell sections of which enclose in each case an air inlet slot which extends tangentially to the swirl chamber, with a burner lance which projects axialwards into the swirl chamber, which lance provides means for feed of liquid fuel into the swirl chamber, and also with further means for feed of liquid fuel which are provided in the region of the air inlet slots. As such, additional means for feed of liquid fuel along at least one air inlet slot are formed and arranged in such a way that the liquid fuel delivery, which is conditioned by the further means, takes place in the form of a fuel spray which propagates perpendicularly to the tangential longitudinal extent of the air inlet slot, and also a fuel spray which propagates perpendicularly to an air flow which is directed through the air inlet slot.

18 Claims, 5 Drawing Sheets

PREMIX BURNER WITH STAGED LIQUID FUEL SUPPLY AND ALSO METHOD FOR OPERATING A PREMIX BURNER

CROSS REFERENCE TO RELATED APPLICATIONS

This application claims priority under 35 U.S.C. §119 to Swiss application 0972/04 filed in Switzerland on 8 Jun. 2004, and as a continuation application under 35 U.S.C. §120 to PCT/EP2005/052315 filed as an International Application on 19 May 2005 designating the U.S., the entire contents of which are hereby incorporated by reference in their entireties.

FIELD

A premix burner is disclosed with staged liquid fuel supply with at least two partial cone shells which on the radial side form the boundary of a swirl chamber which axialwards conically widens, which partial cone shells are arranged in a partially overlapping manner, the center axes of the partial cone shells of which extend with an offset effect in relation to each another, and the mutually overlapping partial cone shell sections of which enclose in each case an air inlet slot which extends tangentially to the swirl chamber, with a burner lance which projects axialwards into the swirl chamber, which lance provides means for feed of liquid fuel into the swirl chamber, and also with further means for feed of liquid fuel which are provided in the region of the air inlet slots.

BACKGROUND INFORMATION

U.S. Pat. No. 5,244,380 describes a premix burner of the type of a partial cone burner, of which the combustion chamber, which axialwards conically widens, is bounded on the radial side by two partial cone shells which are arranged in a position with one inside the other in such a way that their partial cone center axes extend with an offset in relation to each other, wherein the partial cone shells mutually overlap along their partial cone shell side edges and enclose with each other tangentially extending air inlet slots through which air can enter the swirl chamber for further mixing through with fuel. For fuel feed, the premix burner, which is described in the aforesaid publication, provides a fuel nozzle which is installed centrally inside the burner, which fuel nozzle at least partially leads axialwards into the burner from sides of the combustion chamber in the region of the smallest diameter of the combustion chamber, and provides at least one fuel nozzle through which liquid fuel is feedable in the form of a fuel spray cloud which conically expands in the swirl chamber.

The process of the liquid fuel feed and also the subsequent combustion process is basically dividable into the following phases which are temporally separable from each other:

1. Atomizing of the liquid fuel by means of a fuel atomizing nozzle,
2. Vaporizing of the liquid fuel droplets which form in the course of the atomization process,
3. Forming of a fuel-air mixture and, finally,
4. Igniting and combusting of the fuel-air mixture.

In the event that the duration in which the first three phases take place is shorter than the dwell time of the fuel inside the burner (Phase 4), it is to be assumed that the combustion process takes place with complete premixing and with low release of nitrogen oxides. On the other hand, if the dwell time of the fuel inside the combustion chamber is constantly smaller than the time span inside which the rest of the fuel feed phases are forming, then the combustion takes place in the course of a diffusion, as result of which ultimately high portions of nitrogen oxide are released and, furthermore, high turbine exhaust temperatures occur. In order to reliably avoid this, the liquid fuel emerging through the central fuel nozzle is mixed with demineralized water, by means of which are reduced the emission of nitrogen oxide and also the high burner exit temperatures, through which ultimately also the service life of the burner components and also the components which come into contact with the hot gases is limited.

In order to optimize the fuel distribution forming inside the burner and to create preconditions under which it can be ensured that a burning off of the fuel which is fed to the burner is as complete as possible, the premix burner which is described in the aforementioned patent document provides additional fuel nozzles which are installed in the region of the air inlet slots. In this case, the atomization of the liquid fuel takes place in the direction of the longitudinal extent of the respective air inlet slots in order to enable a mixing through of the fuel with the inlet air just before entry into the combustion chamber. However, the only small penetration capability of the fuel feed in the longitudinal direction to the air inlet slots is disadvantageous. This can result in the inner wall regions of the partial cone shells being able to be wetted with fuel, as a result of which burn-off phenomena occurring directly on the inner walls allows the risk of local material overheating happening on the partial cone shells themselves.

SUMMARY

A premix burner is disclosed with staged liquid fuel supply with at least two partial cone shells, which on the radial side form the boundary of a swirl chamber which axialwards conically widens. A premix burner, which is operable with liquid fuel, can be operated in a staged mode of operation, i.e. to operate individually with liquid fuel both a fuel feed through a central burner nozzle and also along the air inlet slots in dependence upon the burner load, for the purpose of a reduced emission of nitrogen oxide within the whole burner load range. In this case, special attention is to be paid to the forming of a constantly stable combustion, extensively avoiding thermoacoustic vibrations which form inside the burner system.

An exemplary premix burner as disclosed herein includes means for feed of liquid fuel, which are arranged along at least one air inlet slot in such a way that the liquid fuel delivery, which is conditioned by the means for feeding of liquid fuel takes place in the form of a fuel spray which propagates perpendicularly to the tangential longitudinal extent of the air inlet slot and also a fuel spray which propagates perpendicularly to an air flow which is directed through the air inlet slot. Unlike the previously described premix burner, the means for liquid fuel feed along the air inlet slot are formed in the form of a plurality of individual fuel nozzles which are arranged along the air inlet slot, preferably in the inner wall region of a partial cone shell, wherein the nozzle outlet orifice of each individual fuel nozzle ends flush with the local partial cone shell wall so that a fuel spray, as a result of atomization of fuel, issues from each individual fuel nozzle, which fuel spray propagates basically perpendicularly to the partial cone wall in the region of the air inlet slot or to a spatial area lying adjacent to the air inlet slot. Naturally, the fuel spray propagates with the forming of a conically expanding cloud in each case, the main direction of propagation of which is perpendicular to the plane of the nozzle outlet orifice. In this way, effectively a wetting of the partial cone wall surfaces with liquid fuel is effectively opposed. Local burn-off phenomena of fuel directly on the surface of the partial cone wall can be completely excluded.

Since, moreover, the air flow entering the burner through an air inlet slot in each case is directed perpendicularly to the direction of propagation of the fuel spray formed by the individual fuel nozzles, the shear forces which occur between the fuel sprays and the air flow promote a shear action which improves the degree of atomization, as a result of which the liquid fuel droplets which are delivered through the fuel nozzles split still further and so become smaller, so that liquid fuel droplets with droplet sizes between 20 and 50 μm are formed, which are subjected to an immediate vaporizing process, as a result of which a completely mixed through fuel-air mixture is ultimately formed.

In an exemplary embodiment, the liquid fuel nozzles which are arranged along the respective air inlet slot are connected by a common liquid fuel line which is modularly integratable in the wall region of a partial cone shell. The number and also the mutual spacing of two adjacent liquid fuel nozzles in each case along such a modularly formed liquid fuel supply unit can be selected taking into account a fuel-air mixture which forms inside the burner.

BRIEF DESCRIPTION OF THE DRAWINGS

Advantageous continuing features, by means of which the premix burner can be complemented, and also a more detailed view of a specific exemplary embodiment, are gatherable with reference to the subsequently described figures. In the drawings.

DETAILED DESCRIPTION

Figure 1:
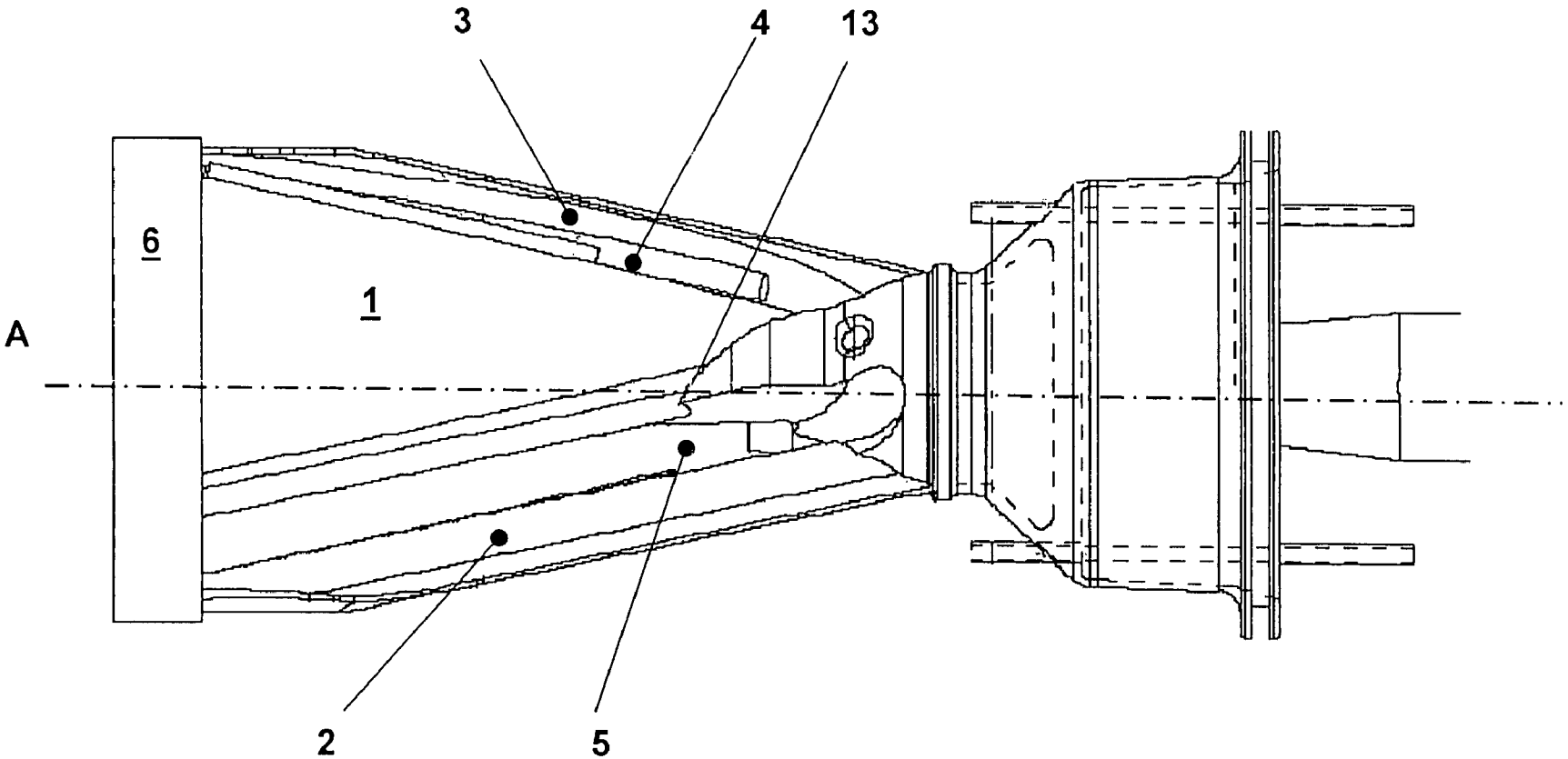
FIG. 1 shows a schematized side view of an exemplary premix burner.
Figure 2:
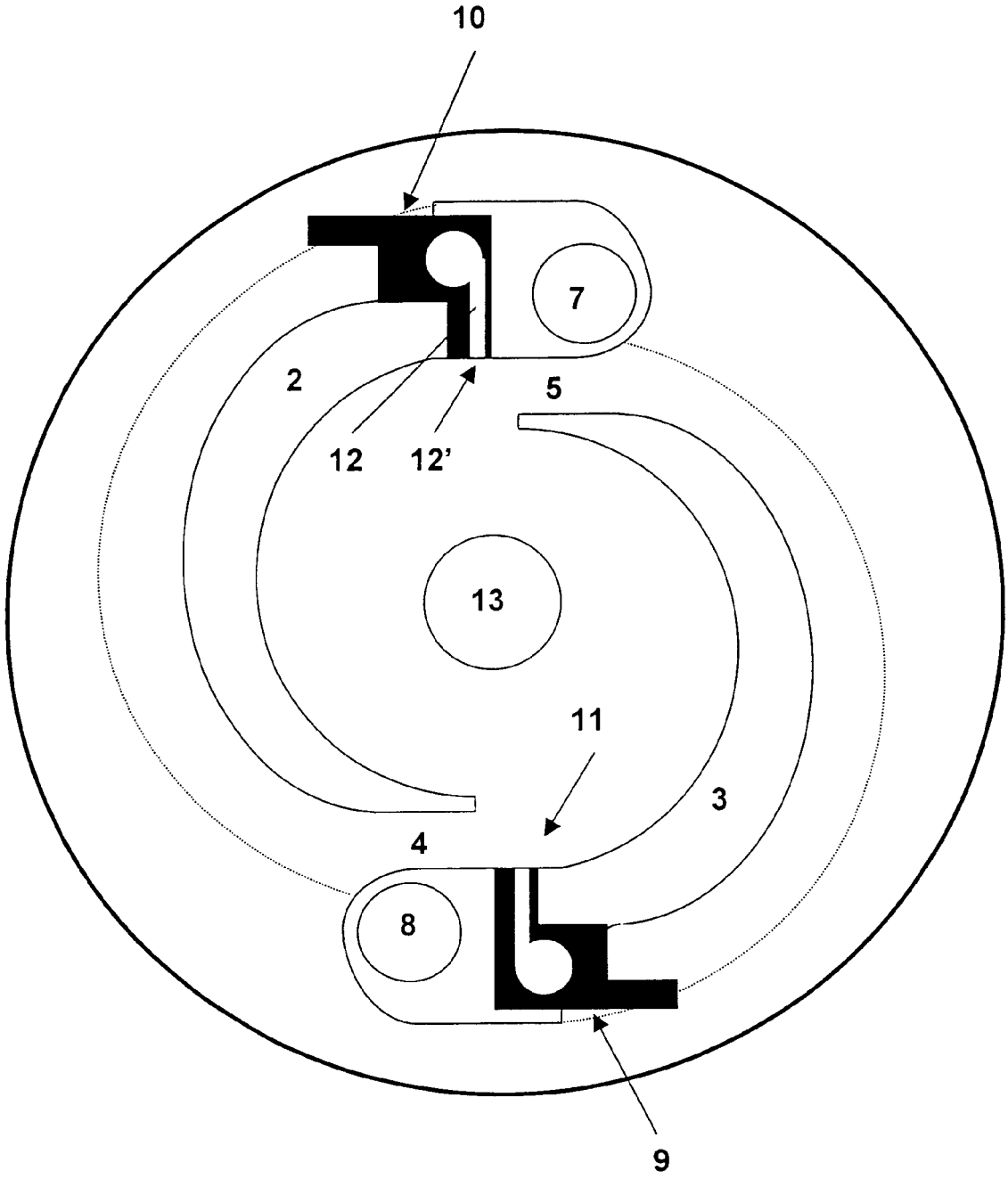
FIG. 2 shows a schematized cross sectional view through the exemplary premix burner which is shown in FIG. 1, along lines of intersection as shown.

For the description of the exemplary cone-form premix burner shown in FIG. 1, which is shown in side view presentation, refer also to the cross sectional view according to FIG. 2. Without further differentiation between FIG. 1 and FIG. 2, reference is made to both figures in the following.

Thus, the premix burner which is shown has a swirl chamber 1, axialwards conically widening, which is radially bounded by two partial cone shells 2, 3. The partial cone shells 2, 3 are arranged in a partially interlocking manner, and by their tangentially extending side edges enclose two air inlet slots 4, 5. Combustion air enters tangentially into the swirl chamber 1 through the air inlet slots 4, 5 which lie symmetrically opposite with regard to the center axis A, and propagates inside the swirl chamber axialwards as a conically expanding swirled flow. The flow characteristic of the swirled flow which forms inside the swirl chamber 1 is determined basically by the clear width of the air inlet slots 4, 5, and also by the cone angle which is included by the two partial cone shells 2, 3 with the center axis A. An annular plate 6 is provided downstream of the burner casing or the partial cone shells 2, 3, as the case may be, which on one hand provides for a discontinuous flow transition at the burner outlet, and, moreover, provides a plurality of perforations through which air is additionally fed into the region of the combustion chamber (not shown), which is connected to the burner downstream, for the purposes of flame stabilization. On account of the discontinuous flow transition between burner and combustion chamber, the swirled flow, which issues from the burner, breaks away and forms a backflow zone, inside which the fuel-air mixture is ignited.

The feed of fuel into the burner usually takes place through a centrally disposed fuel nozzle 13, through which liquid fuel in the form of a most finely atomized fuel spray is introduced into the swirl chamber. It is shown that the external contour of the fuel nozzle 13, and also its position relative to the swirl chamber 1 has a flow-dynamically stabilizing effect on the swirled flow which forms inside the swirl chamber 1. According to embodiment, the centrally installed fuel nozzle 13 can be installed axially centrally in the region of the smallest cross section of the swirl chamber, as it is to be gathered from the exemplary embodiment according to FIG. 1. It is also possible to provide the fuel nozzle 13 at the tip of a burner lance 14 which reaches far into the swirl chamber 1 of the burner (concerning this, see burner cross sectional view according to FIG. 2*a*, which is subsequently referred to in more detail). The aforementioned fuel nozzle arrangement ensures that the ignition event of the liquid fuel spray which is delivered from the burner lance, which mixes with the air flow of the swirled flow, ignites outside the burner inside the backflow zone.

For forming a fuel-air mixture inside the swirl chamber 1, a premix burner, as known per se, in addition to the previously described, centrally disposed fuel nozzle, provides additional fuel feed means by which gaseous fuel can be introduced into the region along the air inlet slots 4, 5. The gaseous fuel is provided through fuel feed lines 7, 8 which extend tangentially to the air inlet slots 4, 5, which is fed into the region of the air inlet slots through fuel nozzles which are not additionally shown. Because of the possibility of fuel feed both through the centrally disposed fuel nozzle 13, and also through the fuel feed lines 7, 8 which are located along the air inlet slots 4, 5, it is possible to carry out the feed of fuel spatially separately from each other, and this in dependence upon the burner load. By means of the spatially separated feed of fuel, which is also designated as staged fuel feed, it is possible to operate the burner within the whole burner load range with the forming of a stable flame inside the backflow zone and also with the lowest possible emissions of nitrogen oxide. In that connection, the centrally disposed fuel nozzle is designated as stage 1, and the fuel feed distributed along the air inlet slots 4, 5 is designated as stage 2.

Burners which are in use up to now provide the feed of liquid fuel through the centrally disposed fuel nozzle, through which either liquid fuel or a mixture of liquid fuel and water is introduced into the swirl chamber. In the case of an emulsion of fuel and water emerging from the centrally disposed fuel nozzle arrangement, the mass ratio of water to liquid fuel is constantly less than 1.0. It is also known to provide within the framework of a dual burner at least one fuel nozzle in the centrally disposed fuel nozzle arrangement, through which gaseous fuel can be fed axialwards and/or radialwards into the swirl chamber.

In order to optimize the dual burner concept, but especially also to create the possibility of being able to operate a burner exclusively with liquid fuel within the whole burner load range, liquid fuel supply units 9, 10, which to large extent are parallel to the gas feed lines 7, 8 which already exist, are provided in the region of the air inlet slots 4, 5, by which liquid fuel can be purposefully added to the air flow which enters through the air inlet slots 4, 5. In an especially advantageous embodiment according to FIG. 2, the liquid fuel supply units 9, 10 in each case are formed as a modular unit which in each case is at least partially integratable in a partial cone shell 2, 3 in the region of its leading edge, so that in each case the air flows entering through the air inlet slots 4, 5 remain as far as possible unimpaired by these. The liquid fuel supply units 9, 10, which are considered as stage 2, provide in each case a plurality of nozzle outlet orifices 11 which are located in the longitudinal direction to the leading edge of the partial cone shells 2, 3, by which liquid fuel is atomized into the smallest fuel droplets. The number of the individual nozzle outlet orifices 11, and also their mutual tangential spacing, depends upon a desired achievable liquid fuel-air distribution, and can be selected according to size, shape and form of the premix burner, taking into account the lowest possible emissions of nitrogen oxide to be striven for, and also in terms of avoiding combustion chamber pulsations in a suitable manner. It is especially necessary to select the number and also the spatial distribution of the liquid fuel nozzle orifices along the leading edge of the respective partial cone shells 2, 3 in a way so that spontaneous ignitions in defined operating ranges can be excluded.

Nozzle orifice diameters of less than 1 mm, combined with a typical nozzle length of about 1 to 10 mm, have proved to be as especially suitable. In this connection, reference is made to the schematized cross sectional view in FIG. 2, from which it can be gathered that each individual liquid fuel nozzle consists of a nozzle passage 12 and a nozzle orifice 11, which abuts flush on the inner side of the partial cone shell so that the liquid fuel spray which propagates from each individual fuel nozzle propagates preferably perpendicularly to the inner wall of the partial cone shell. The fuel spray which propagates from each individual fuel nozzle forms a conically expanding fuel spray cloud which includes a cone angle of ±45° with regard to an axis perpendicularly intersecting the nozzle orifice. In order to avoid the wall regions of the partial cone shells which lie opposite the respective nozzle orifices being wetted by the propagating fuel spray clouds, the liquid fuel supply units 9, 10 are installed preferably downstream on the leading edge of a respective partial cone shell 2, 3, so that no partial cone shell wall lies opposite the nozzle outlet orifices 11, and so the fuel spray clouds which issue from the fuel nozzle orifices can propagate freely into the inside of the swirl chamber 1.

A fuel supply pressure of at least 20 bar is to be provided inside the liquid fuel lines in order to ensure a degree of atomization which is as high as possible, and also to ensure a penetration depth of the liquid fuel to be introduced into the swirl chamber through the liquid fuel supply units which is as great as possible, i.e. fuel droplets with droplet diameters of 50 μm maximum, preferably between 20 and 50 μm, are to aimed for.

In addition to the use of most simple fuel nozzles with a nozzle passage which extends rectilinearly and a flat nozzle orifice, as they can be gathered from the schematized presentation in FIG. 2 and which in a manner, as known per se, are known from the field of diesel engines, a further exemplary embodiment provides the use of liquid fuel nozzles which have nozzle contours by means of which a local pressure increase is caused, which leads to an increased formation of turbulence inside the liquid which is to be atomized.

For forming of fine liquid fuel droplets, extremely high shear forces can prevail between the liquid fuel sprays which issue from the individual fuel nozzles and the air flows which enter through the air inlet slots 4, 5. Since the fuel nozzle orifices 11 are arranged in the direction of flow directly after the narrowest flow cross section of the air inlet slots 4, 5, maximum air flow velocities occur in the region of the liquid fuel nozzle orifices, which lead to especially large shear forces, as a result of which, on one hand, the liquid fuel cloud which is forming is entrained normally in the direction of flow of the air flow, by which wetting by liquid fuel on wall areas of the partial cones is avoided, and, on the other hand, the liquid droplets which are delivered from the liquid fuel nozzles are further split up.

On account of the very small size of fuel droplets, with fuel droplet diameters between 20 and 50 μm, a complete vaporization is ensured of the liquid fuel inside the air flow which forms for the swirled flow, as a result of which a homogenous and completely vaporized fuel-air mixture is ignited in the region of the backflow zone, forming a spatially stable flame.

On account of the fuel feeds of gaseous and liquid fuels, which extend parallel and along the air inlet slots 4, 5, the burner in an advantageous way provides the possibility of a dual burner concept, which can be operated in dependence upon the respective fuel supply and/or the burner load.

Figure 3:
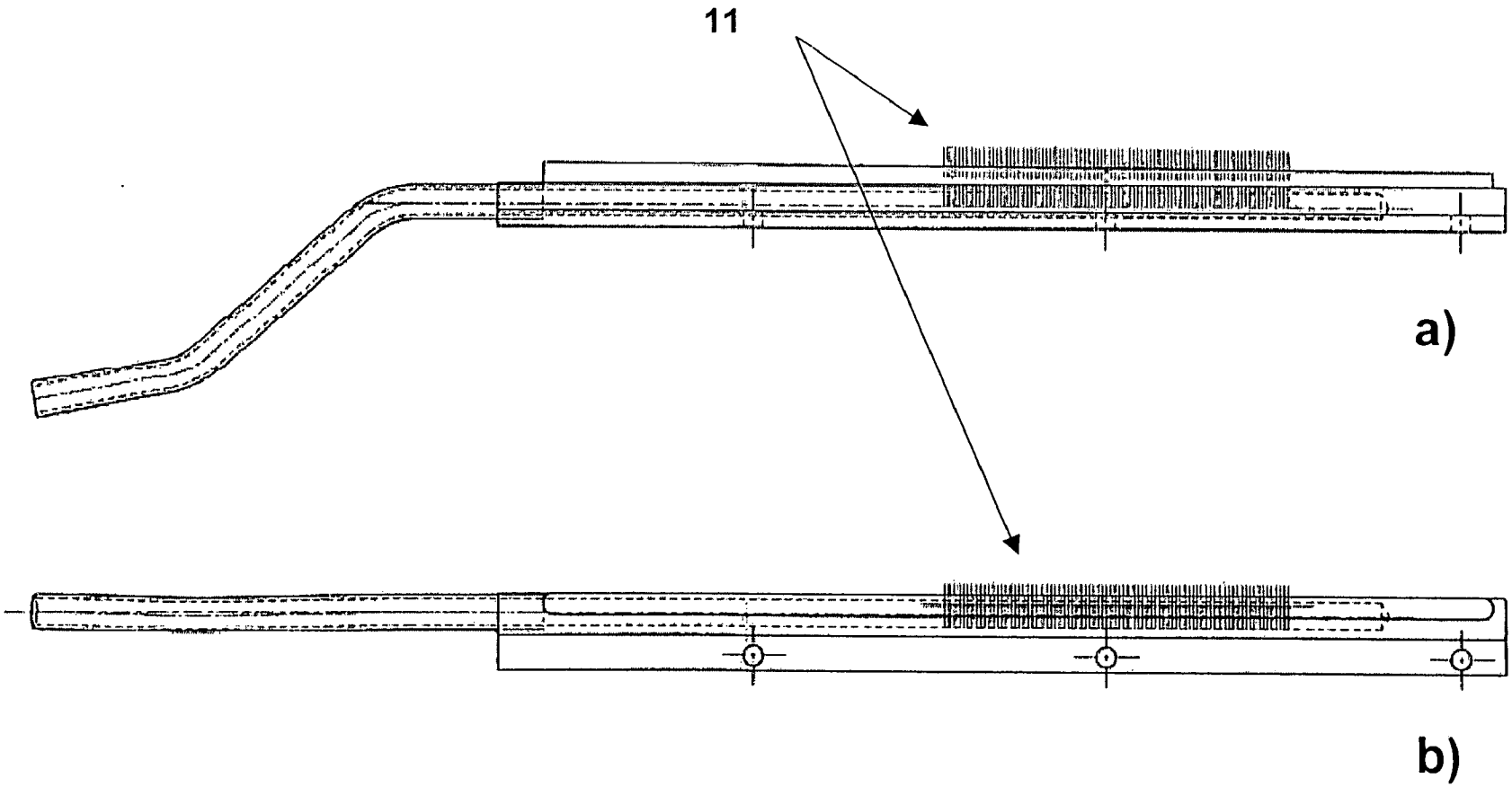
FIGS. 3*a, b* show modularly formed exemplary liquid fuel supply units.

Because of the modular construction of the liquid fuel supply units 9, 10, moreover, the retrofittability to existing burner systems is basically possible. Therefore, the liquid fuel supply units, which are to be modularly integrated in recesses which are to be provided inside the partial cone shells in each case, can be formed as one-piece supply lines, as they are shown in detail in FIG. 3. The upper presentation in FIG. 3 shows an exemplary liquid fuel passage which is adaptable to the external contour of a conically formed double cone burner, according to the presentation in FIG. 1 or 2. The fuel nozzles, which are spaced equidistantly from each other, are represented by the designation number 11.

The lower presentation in FIG. 3 shows an exemplary fuel line which is formed rectilinearly, which is used in conjunction with a mixing pipe which is connected directly downstream to a conically formed premix burner. Reference is subsequently made to such an embodiment variant by referring to FIG. 4*b*.

Figure 4:
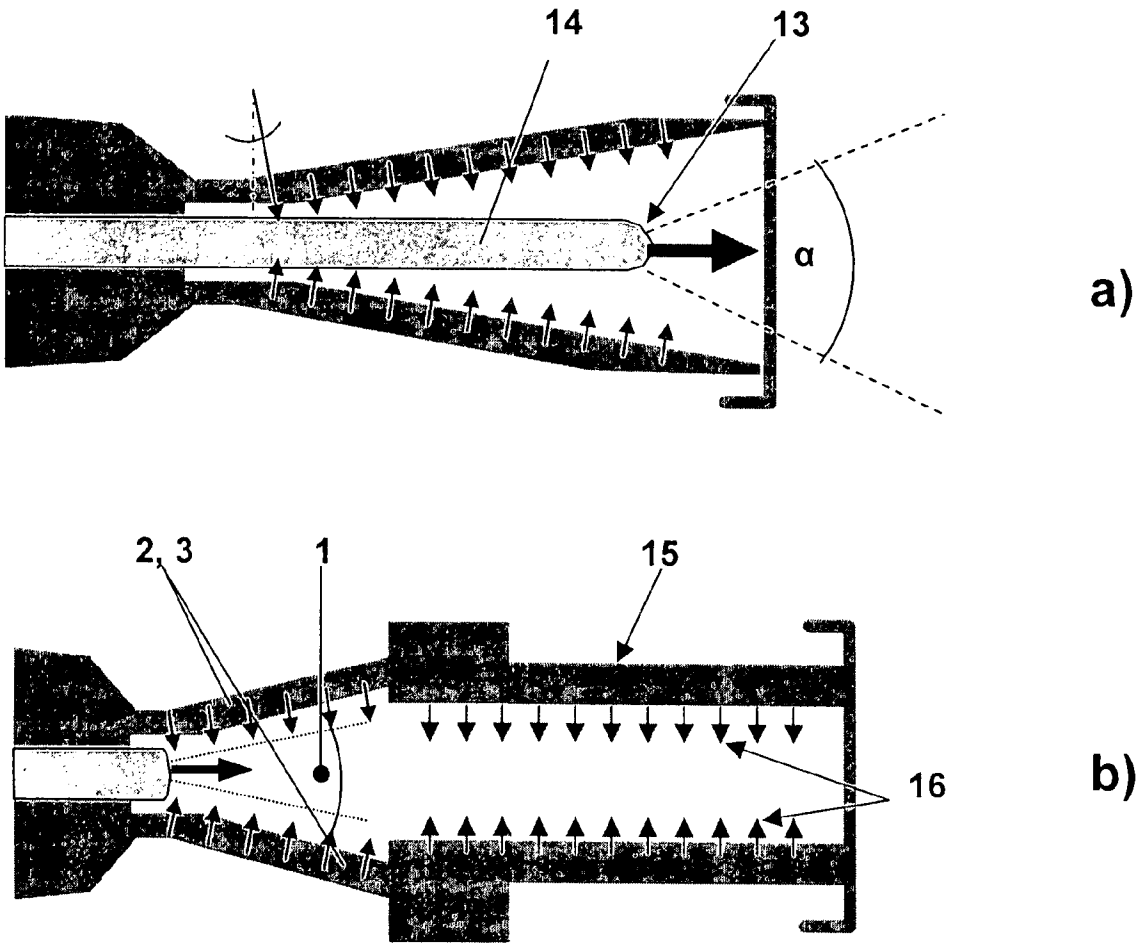
FIGS. 4*a, b* show sectional views through an exemplary premix burner, and also premix burners with subsequent mixing pipe.
FIGS. 4*c-e* show sectional views through various alternative exemplary premix burners, showing various different exemplary liquid fuel nozzle arrangements.

In FIG. 4*a*, first reference is again made to the use of a burner lance 14 of long construction, on the burner lance tip of which is provided a liquid fuel nozzle arrangement 13 from which a liquid fuel cloud, which conically propagates at an angle α, is delivered in the axial direction. The different pressurized atomizing techniques, by which liquid fuel is delivered from the end region of the burner lance 14, are sufficiently well-known to a person skilled in the art. Thus, atomizing angles α between 0° and 90° can be set, according to the nozzle form in each case. For the protection of the burner lance tip against overheating, it is also possible to provide additional air outlets which enable the burner lance tip to be effectively cooled. In addition, by means of a suitably selected aerodynamic shaping of the lance tip, the flow field which determines the flame is favorably influenceable, so that a flame front which is as stable as possible can form inside the combustion chamber.

The liquid fuel delivery through the centrally disposed burner lance 14 is especially suitable for the start-up or light-up of the burner, as the case may be, and also for lower burner load ranges. For the medium and higher burner load, the fuel feed is to be carried out through the previously described fuel nozzles which are arranged with distribution along the air inlet slots 4, 5.

If, as shown in FIG. 4*b*, the burner provides a mixing pipe 15 which is connected to the partial cone shells 2, 3, in which mixing pipe the air-fuel mixture which forms inside the swirl chamber 1 is able to mix through more completely, it has been proved to be especially advantageous to provide liquid fuel nozzles 16 along the mixing pipe 15 similar to those which are installed in the region of the air inlet slots 4, 5 according to the invention. Liquid fuel supply units, as they are schematically shown with reference to the lower presentation of FIG. 2, are suitable for such liquid fuel feeds which are to be carried out along the mixing pipe.

Figure 4C:
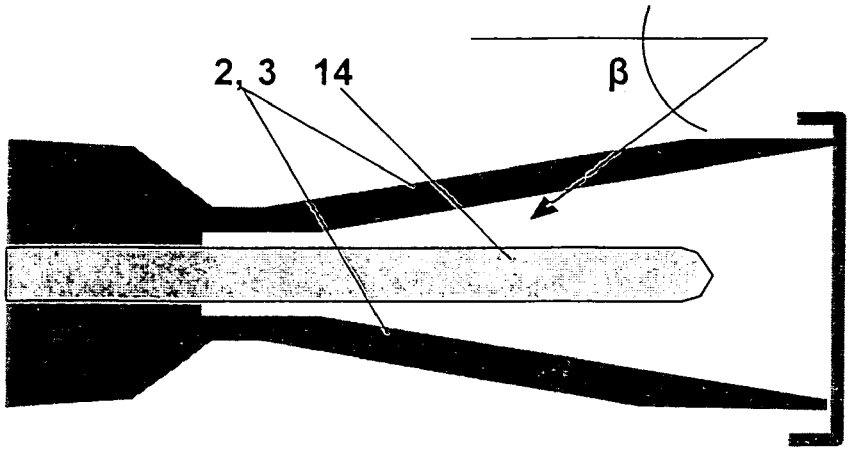

A longitudinal sectional view through a premix burner, with partial cone shells 2, 3 and a long burner lance 14, is shown in FIG. 4*c*. The fuel nozzles 11, which are arranged distributed along the air inlet slots (not visible) which are enclosed by the partial cone shells 2, 3, are installed at an angle β of inclination to the burner axis A, of which fuel nozzles only one is drawn in a stylized manner. The angle β of inclination in this case is orientated in such a way that the nozzle outlet direction is orientated preferably against the main flow direction (see arrow) which forms inside the swirl chamber 1. However, also inclinations in the direction of the main flow direction are conceivable as well. Therefore, β can basically assume values for which applies $\gamma<\beta<(\gamma+180°)$, wherein γ is the opening angle of the premix burner.

Figure 4D:
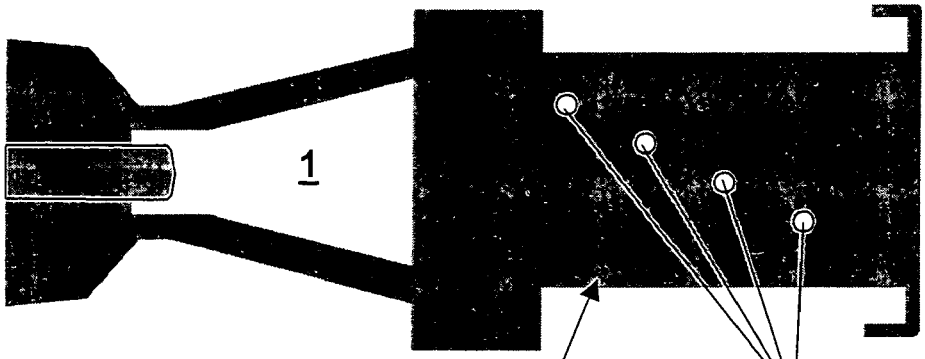
Figure 4E:
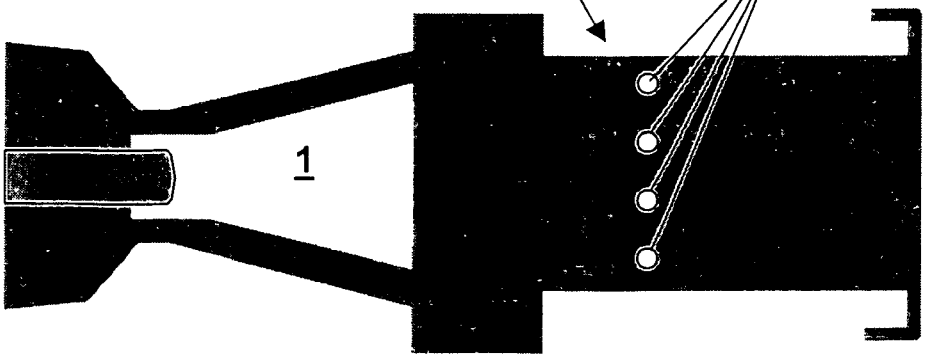

Premix burners with a mixing pipe 15 in each case are shown in FIGS. 4*d* and *e*. The exemplary embodiments are to illustrate the arrangement geometry of the liquid fuel nozzles 16. Thus, the liquid fuel nozzles 16 can be arranged either in the circumferential direction (FIG. 4*d*) or in an axial row with different positions (FIG. 4*e*) in each case which are orientated in the circumferential direction. In the case of FIG. 4*d*, a plurality of rows of liquid fuel nozzles, which are arranged distributed in the circumferential direction, can be provided for the targeted reduction of thermoacoustic oscillations which form inside the burner. In the case of the liquid fuel nozzle arrangement according to FIG. 4*e*, defined fuel enriched regions or corresponding lean regions can be created which are radially and/or axially delimited inside the mixing pipe.

In the course of an exemplary liquid fuel feed along the air inlet slots in the previously described manner, a significantly improved mixing through of vaporized liquid fuel with the air which reaches the swirl chamber through the air inlet slots becomes possible, which gives rise to a stable combustion with much reduced emission of nitrogen oxide. The liquid fuel atomization along the air inlet slots can enable a stable burner operation without the addition of water, or only with the smallest portions of water, as the case may be.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF DESIGNATIONS

1 Swirl chamber
2, 3 Partial cone shell
4, 5 Air inlet slots
6 Annular sealing plate
7, 8 Gas feed line
9, 10 Liquid fuel feed line
11 Fuel nozzle
12 Nozzle passage
12' Nozzle orifice
13 Fuel nozzle
14 Burner lance
15 Mixing pipe
16 Liquid fuel nozzles

The invention claimed is:

1. A premix burner with staged liquid fuel supply, comprising:

at least two partial cone shells which on the radial side form the boundary of and define a swirl chamber which axialwards conically widens, which partial cone shells are arranged in a partially overlapping manner, the center axes of the partial cone shells of which extend with offset effect in relation to each another, and the mutually overlapping partial cone shell sections of which enclose in each case an air inlet slot which extends tangentially to the swirl chamber;

a burner lance which projects axialwards into the swirl chamber, which lance provides means for feed of liquid fuel into the swirl chamber, and also with further means for feed of liquid fuel which are formed and arranged in the region of the air inlet slots in such a way that the liquid fuel delivery, which is conditioned by the further means, takes place in the form of a fuel spray which propagates perpendicularly to the tangential longitudinal extent of the air inlet slot, and also a fuel spray which propagates perpendicularly to an air flow which is directed through the air inlet slot; and a mixing pipe is axialwards directly connected downstream to the swirl chamber and upstream to a combustion chamber wherein no combustion occurs within the mixing pipe, and wherein the further means for liquid fuel feed extend axialwards at least into sections of the mixing pipe in such a way that a liquid fuel feed which is directed radially inwards into the mixing pipe is executable.

2. The premix burner as claimed in claim 1, wherein the further means are formed as fuel nozzles which are arranged distributed along the air inlet slots.

3. The premix burner as claimed in claim 2, wherein the fuel nozzles have in each case a nozzle orifice diameter which is less than or equal to 1 mm.

4. The premix burner as claimed in claim 2, wherein the fuel nozzles have a nozzle passage which is less than or equal to 10 mm, which preferably lies between 1 mm and 10 mm.

5. The premix burner as claimed in claim 2, wherein the fuel spray which issues from each individual fuel nozzle expands in the form of a conically expanding fuel spray cloud which has an opening angle of ±45° with regard to the center axis of the conically expanding fuel spray cloud.

6. The premix burner as claimed in claim 2, wherein the fuel nozzles, which are arranged distributed along the air inlet slots, create a pressure drop of at least 20 bar for producing a fuel spray with droplet diameters of between 20 and 30 μm.

7. The premix burner as claimed in claim 2, wherein the fuel nozzles are installed in each case in a partial cone shell, downstream to the air inlet slot which is bounded by the mutually overlapping partial cone shells.

8. The premix burner as claimed in claim 7, wherein the fuel nozzles are arranged in a partial cone shell in such a way that the fuel spray which issues from a fuel nozzle in each case propagates unhindered into the swirl chamber.

9. The premix burner as claimed in claim 8, wherein the further means for liquid fuel feed, which are formed as fuel nozzles, are arranged in the circumferential direction around the mixing pipe.

10. The premix burner as claimed in claim 8, wherein the further means for liquid fuel feed, which are formed as fuel nozzles, are arranged in the axial extent, and are arranged in the circumferential direction around the mixing pipe with different positions in each case.

11. The premix burner as claimed in claim 10, wherein the further means for feed of liquid fuel are arranged and formed in such a way that a liquid fuel entry into the region of the air inlet slot in each case takes place at a variable or a fixed determinable angle β relative to the axis A of the premix burner.

12. The premix burner as claimed in claim 11, wherein the burner lance, which projects axialwards into the swirl chamber, in addition to the means for feed of liquid fuel, also provides means for feed of water or water vapor into the swirl chamber.

13. The premix burner as claimed in claim 12, wherein the fuel nozzles, which are arranged distributed along the air inlet slots, create a pressure drop of at least 20 bar for producing a fuel spray with droplet diameters of between 20 and 30 μm.

14. The premix burner as claimed in claim 1, wherein the further means for feed of liquid fuel are modularly formed in the form of a liquid fuel supply unit in each case, which is integratable into a partial cone shell in each case, and has a plurality of fuel nozzles which are arranged along the liquid fuel supply unit.

15. The premix burner as claimed in claim 1, wherein the further means for liquid fuel feed, which are formed as fuel nozzles, are arranged in the circumferential direction around the mixing pipe.

16. The premix burner as claimed in claim 1, wherein the further means for liquid fuel feed, which are formed as fuel nozzles, are arranged in the axial extent, and are arranged in the circumferential direction around the mixing pipe with different positions in each case.

17. The premix burner as claimed in claim 1, wherein the further means for feed of liquid fuel are arranged and formed in such a way that a liquid fuel entry into the region of the air inlet slot in each case takes place at a variable or a fixed determinable angle β relative to the axis A of the premix burner.

18. The premix burner as claimed in claim 1, wherein the burner lance, which projects axialwards into the swirl chamber, in addition to the means for feed of liquid fuel, also provides means for feed of water or water vapor into the swirl chamber.

* * * * *